US008814555B1

(12) United States Patent
Hensley, Sr. et al.

(10) Patent No.: US 8,814,555 B1
(45) Date of Patent: Aug. 26, 2014

(54) DRYWALL TAPERING DEVICE

(71) Applicants: Alex G. Hensley, Sr., West Virginia, WV (US); Paul H. Balentine, West Virginia, WV (US)

(72) Inventors: Alex G. Hensley, Sr., West Virginia, WV (US); Paul H. Balentine, West Virginia, WV (US)

( * ) Notice: Subject to any disclaimer, the term of this patent is extended or adjusted under 35 U.S.C. 154(b) by 0 days.

(21) Appl. No.: 14/141,031

(22) Filed: Dec. 26, 2013

Related U.S. Application Data

(60) Provisional application No. 61/855,631, filed on May 20, 2013.

(51) Int. Cl.
*B28B 11/10* (2006.01)

(52) U.S. Cl.
USPC ..... 425/367; 52/749.1; 156/348; 425/363

(58) Field of Classification Search
CPC ..... B28B 11/0863
USPC ..... 425/363, 367, 471; 156/348; 52/749.1
See application file for complete search history.

(56) References Cited

U.S. PATENT DOCUMENTS

| | | | | |
|---|---|---|---|---|
| 1,452,742 | A * | 4/1923 | Johnston | 425/374 |
| 1,676,318 | A | 7/1928 | Birdsey | |
| 2,991,824 | A | 7/1961 | Loechl | |
| 3,180,058 | A | 4/1965 | Tillisch et al. | |
| 3,233,301 | A * | 2/1966 | Tillisch et al. | 425/385 |
| 4,584,224 | A * | 4/1986 | Schneller | 428/60 |
| 5,198,052 | A * | 3/1993 | Ali | 156/45 |
| 5,230,200 | A | 7/1993 | Douglas et al. | |
| 6,230,469 | B1 | 5/2001 | Santa Cruz et al. | |
| 6,450,232 | B1 * | 9/2002 | Smythe, Jr. | 156/579 |
| 6,931,814 | B2 | 8/2005 | Henits | |
| 7,178,217 | B2 * | 2/2007 | Barnett | 29/557 |
| 7,223,311 | B2 * | 5/2007 | Conboy | 156/45 |

FOREIGN PATENT DOCUMENTS

DE 197 44 853 C1 2/1999

OTHER PUBLICATIONS

"ButtTaper, Drywall Butt Joint Kit," Warehouse Bay website: www.warehousebay.com/catalog/butttaper-drywall-butt-joint-kit/?osCsid=0ef0b460025d7d11d8e720b1f02ebafl, Retrieved on Sep. 16, 2013, 2 pages.

* cited by examiner

*Primary Examiner* — James Mackey
(74) *Attorney, Agent, or Firm* — Richard C Litman

(57) ABSTRACT

The drywall tapering device has a drive roller and two idler rollers extending from the front face of a frame in a triangular configuration with the drive roller above the idler rollers. The drive roller has an annular groove defined around its base and tapers in diameter from wide to narrow as the roller extends from the base to its free end. The butt end of a drywall panel is supported against an elongate track. The frame is clamped over the butt end and the track, a spring-biased adjustment screw assembly being used to clamp the drive roller against the butt end with the track engaging the groove. A drill grips a mandrel extending from the drive roller and causes the drive roller to rotate and ride along the track, forming a tapered recess in the butt end of the drywall, the idler rollers following below the track.

20 Claims, 7 Drawing Sheets

DRYWALL TAPERING DEVICE

CROSS-REFERENCE TO RELATED APPLICATION

This application claims under 35 U.S.C. §119 priority to and the benefit of U.S. Provisional Patent Application Ser. No. 61/855,631, filed May 20, 2013 in the United States, and is incorporated herein by reference in its entirety.

BACKGROUND OF THE INVENTION

1. Field of the Invention

The present invention relates to building construction, and particularly to a drywall tapering device for tapering the ends of drywall sheets so that butt joints can be covered by paper tape and joint compound, eliminating unsightly butt joints.

2. Description of the Related Art

Drywall has largely replaced plaster and lath in the construction and remodeling of homes and offices, such as in the construction of interior walls or ceilings. Sheets or panels of drywall, conventionally supplied as 4'×8' or 4'×16' sheets, are fastened to the wall studs or ceiling joists, either vertically or horizontally, by drywall nails or screws. The elongated 8' or 16' sides are formed with tapered edges so that paper tape can be placed in the tapered recesses of adjoining panels and secured with joint compound to form a smooth joint that is hardly noticeable when painted. However, when the wall or ceiling is longer than eight feet, it can be necessary to place two or more panels end-to-end, forming a butt joint. The ends of drywall panels are either tapered or not tapered. Typically, butt joints are simply covered with joint compound and smoothed by sanding. Over time, however, the joint can spread slightly as the studs and joists expand and contract in response to thermal stress, resulting in ridges or gaps forming along the seam of the butt joint.

Thus, a drywall tapering device addressing the aforementioned problems is desired.

SUMMARY OF THE INVENTION

The drywall tapering device has a drive roller and two idler rollers extending from the front face of a frame in a triangular configuration with the drive roller above the idler rollers. The drive roller has an annular groove defined around its base and tapers in diameter from wide to narrow as the roller extends from the base to its free end. The butt end of a drywall panel is supported against an elongate track. The frame is clamped over the butt end and the track, a spring-biased adjustment screw assembly being used to clamp the drive roller against the butt end with the track engaging the groove. A drill grips a mandrel extending from the drive roller and causes the drive roller to rotate and ride along the track, forming a tapered recess in the butt end of the drywall, the idler rollers following below the track.

Two drywall panels having tapered recesses formed in this manner can be placed end-to-end and taped with drywall tape and joint compound to form a smooth, secure seam.

The drive roller is rotatably mounted in a mounting tube that is vertically slidable in a slot defined in the frame. The mounting tube has front and rear annular disks disposed against the front and rear faces of the frame to constrain the tube to slide in the slot. A stud having a compression spring coaxially disposed around its shank is positioned below the rear annular disk. A threaded bolt extends through the top of the frame, and a knob is mounted on the free end of the threaded bolt. The opposite end of the threaded bolt bears against the rear annular disk, pressing the rear annular disk against the compression spring to fix the height of the drive roller. The height of the drive roller can be adjusted by using the knob to screw the threaded bolt into and out of the frame, thereby clamping the drive roller against drywall panels, such as of a conventional thickness, e.g., ½ inch, ⅝ inch, etc.

These and other features of the present invention will become readily apparent upon further review of the following specification and drawings.

BRIEF DESCRIPTION OF THE DRAWINGS

Unless otherwise indicated, similar reference characters denote corresponding features consistently throughout the attached drawings.

DETAILED DESCRIPTION OF THE PREFERRED EMBODIMENTS

Figure 1:
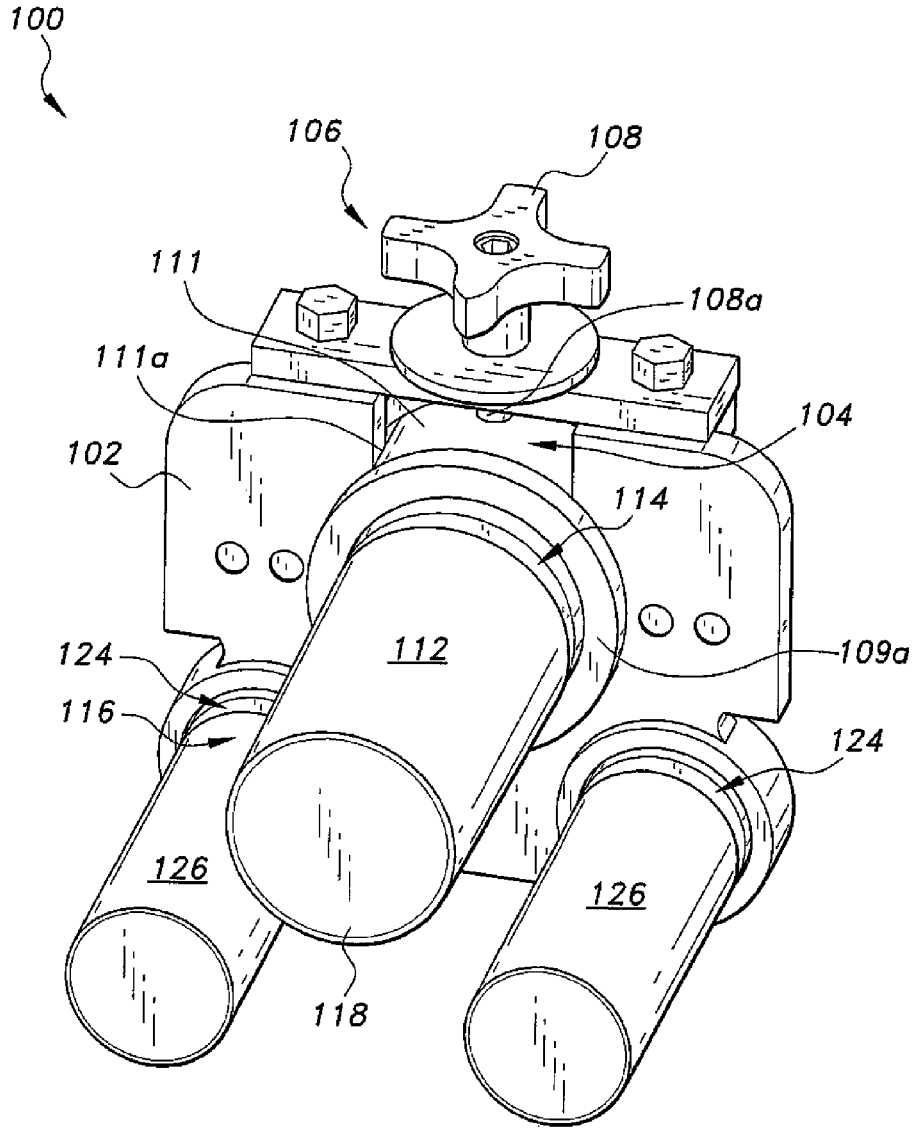
FIG. 1 is a perspective view of an embodiment of a drywall tapering device according to the present invention.
Figure 5A:
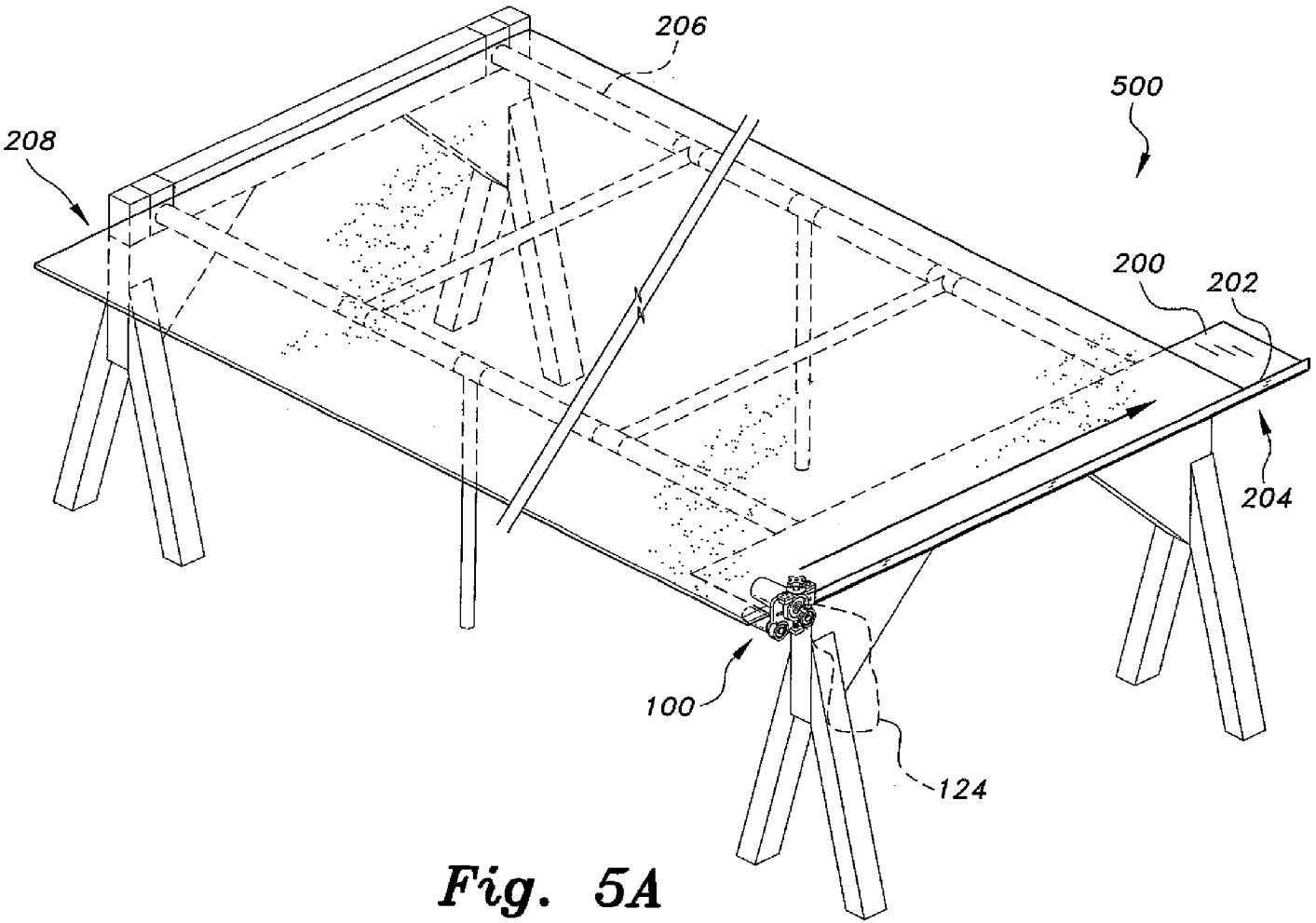
FIG. 5A is a perspective view of a system for tapering drywall according to the present invention.
Figure 5B:
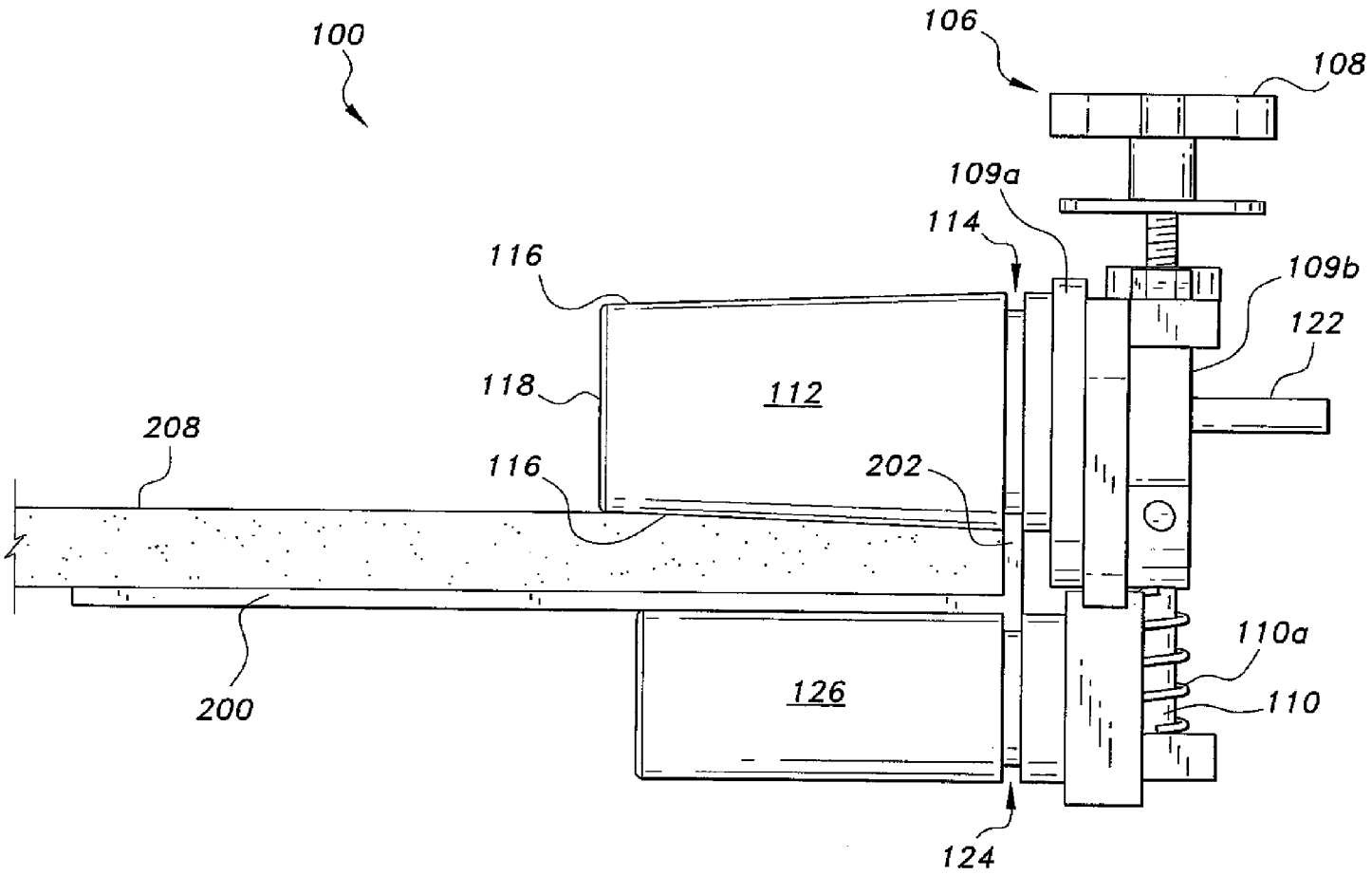
FIG. 5B is a detailed side view of the drywall tapering device and the track in the system for tapering drywall shown in FIG. 5A.

Referring to FIGS. 1-5B, a drywall tapering device 100 is shown. The drywall tapering device 100 includes a frame 102 and channel or slot 104 defined on the frame 102. As shown in FIGS. 1-4, the slot 104 can extend through the frame 102 to form a cut-out region. Communicating with the slot 104 of the frame 102 is a drive roller 112. The drive roller 112 includes an annular groove 114 defined around its base. The annular groove 114 is situated around the perimeter of the drive roller 112 and is adapted to receive a lip 202 of a track 200, as shown in FIG. 5B. By receiving the lip 202, the drive roller 112 and the frame 102 of the drywall tapering device 100 can be moved linearly along the track 200 in a controlled manner. In addition to the annular groove 114, the drive roller 112 has a shape that includes a circumferential taper 116 extending from the annular groove 114 towards a front edge 118 at the distal end of the drive roller 112. The taper 116 is formed by a decrease in diameter along the length of the drive roller 112 from wide at the base to narrow at the distal end. As shown in FIGS. 1-513, the taper 116 of the drive roller 112 forms a generally frustoconical shape or any suitable shape that fits the user's needs. This taper 116 of the drive roller 112 can allow for a corresponding tapered butt end, such as the tapered edge 606*b* shown in FIG. 6B, to be formed on an end of a sheet, panel, board, or web 208 when the sheet 208 is placed beneath the drive roller 112 and the frame 102 of the drywall tapering device 100 is moved along the edge of the sheet of material 208.

Figure 2:
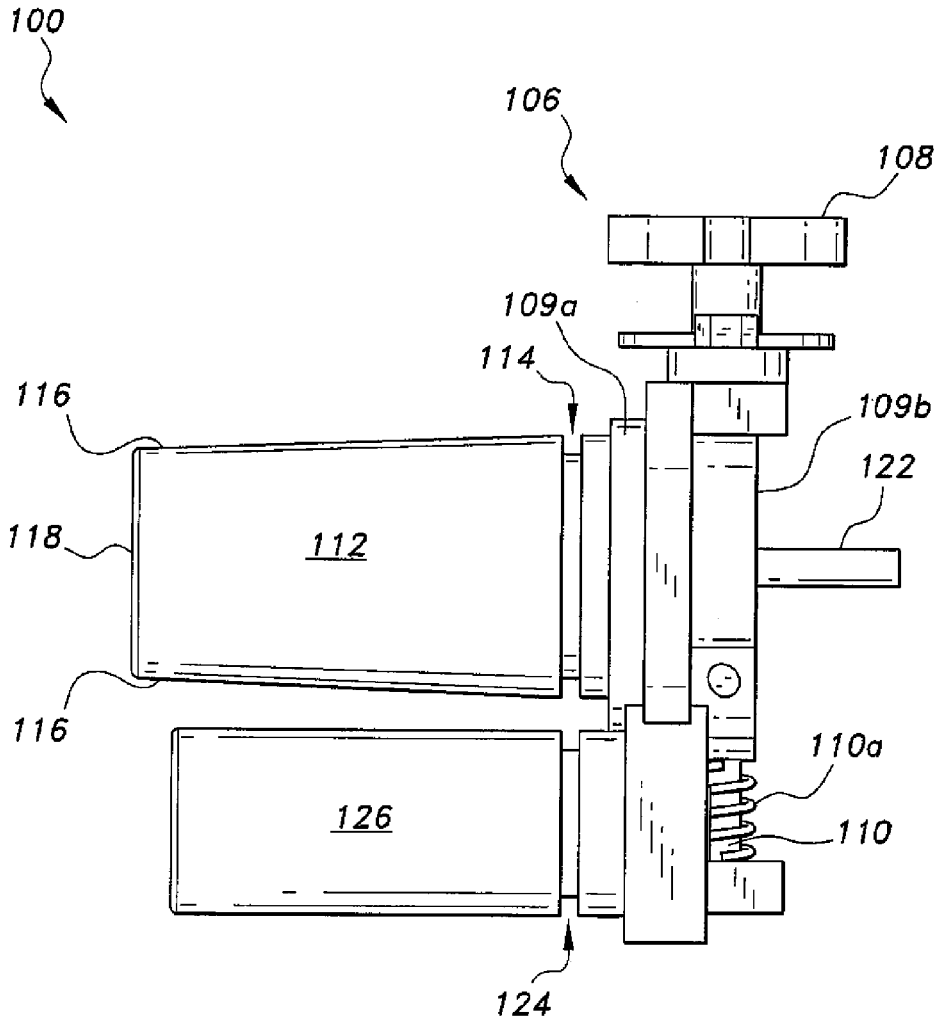
FIG. 2 is a side view of the drywall tapering device shown in FIG. 1.
Figure 3:
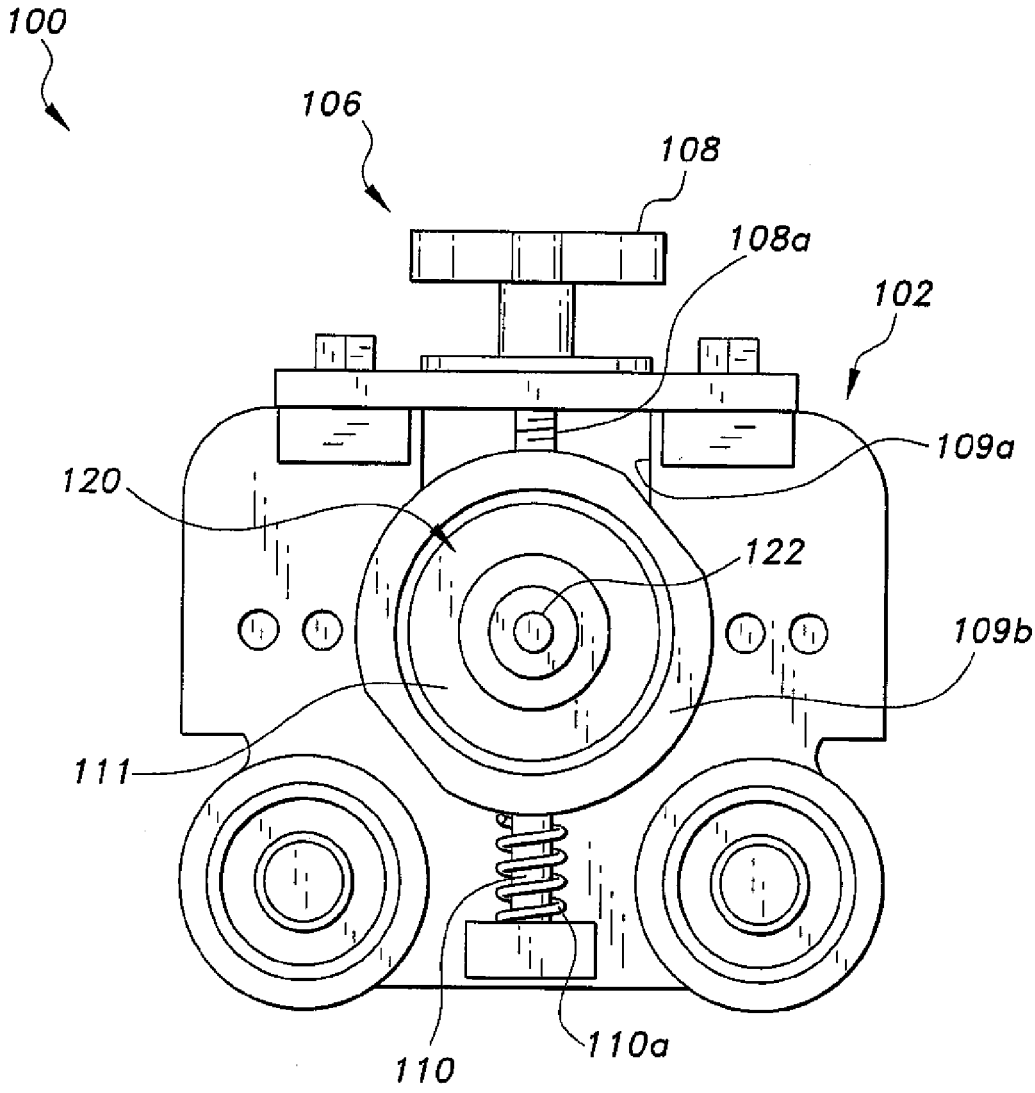
FIG. 3 is a rear view of the drywall tapering device shown in FIG. 1.
Figure 4:
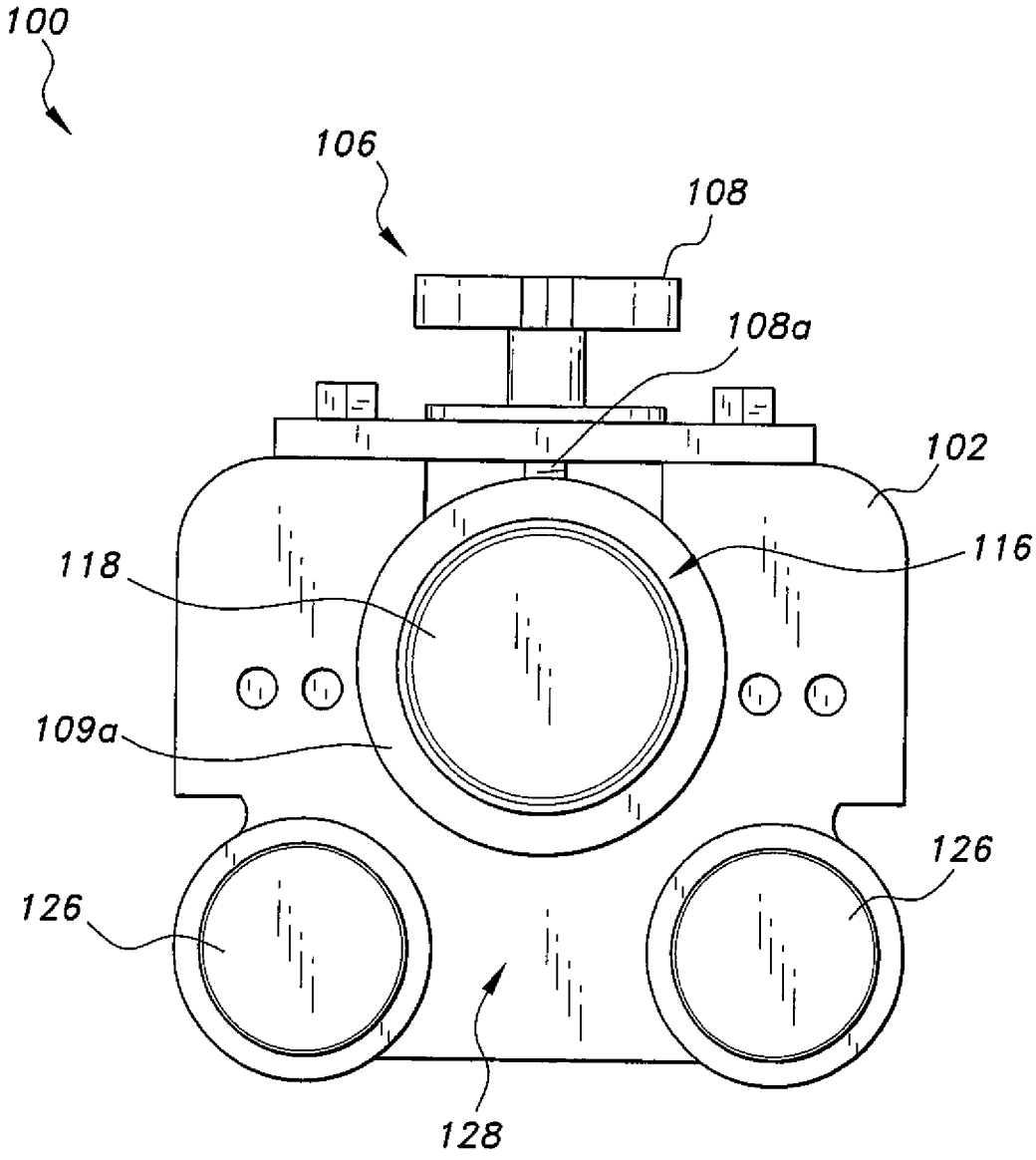
FIG. 4 is a front view of the drywall tapering device shown in FIG. 1.

In order to facilitate movement of the drywall tapering device 100, the drywall tapering device includes a drive attachment 122 extending from the rear 120 of the drive roller 112 as shown in FIGS. 2 and 3. The drive attachment 122 assists in moving the frame 102 across the track 200 by communicating with a drive mechanism 124. In this embodiment, the drive attachment 122 can be an elongate mandrel for selective coupling with the drive mechanism 124, the drive mechanism 124 selectively gripping the mandrel 122 and rotating the drive roller 112. Desirably, the drive mechanism 124 can be a cordless power drill, such as having a ½ inch bit, as exemplarily shown in FIG. 5A. Other examples of drive mechanisms include, but are not limited thereto, power tools, pneumatic tools, manual tools, or any instrument that can be selectively coupled to the drive attachment 122 and rotate the same. Rotation of the drive roller 112 facilitates concurrent movement of the drive roller 112 and the frame 102 of the drywall tapering device 100 along the track 200 while the drive roller 112 forms a tapered edge on the desired butt end of the sheet 208.

The drive roller 112 can be adjustably positioned along the slot 104 of the frame 102 by a controller 106 in order accommodate various thicknesses of sheets 208. The drive roller 112 is rotatably mounted in a mounting housing 111 configured to vertically slide inside the slot 104. In this instance, the mounting housing 111 is constructed as a mounting tube with the drive attachment 122 extending outwardly from the back of the mounting housing 111. Desirably, the diameter of the mounting housing 111 is about the same as the width of the slot 104 so that the mounting housing 111 can be received in the slot 104 with minimal tolerances which can help to minimize undesirable rotation of the mounting housing 111 within the slot 104. Also, the diameter of the mounting housing 111 can be constructed with a diameter larger than the width of the slot 104 so that diametric opposing sides can be ground, milled, or molded to form guide faces or surfaces 111*a* of the mounting housing 111. The guide faces 111*a* can permit the mounting housing 111 to fit and slide within the slot 104 and can provide an abutment surface to assist in preventing relative rotation of the mounting housing 111 therein.

The mounting housing 111 also includes a front annular disk 109*a* and a rear annular disk 109*b* disposed thereon, the front and rear annular disks 109*a*, 109*b* being spaced apart from each other so as to straddle the frame 102 therebetween. When installed, the annular disks 109*a*, 109*b* are disposed on opposite sides of the frame 102 and thereby can assist in preventing undesirable axial movement of the mounting housing 111 with respect to the frame 102. This arrangement constrains movement of the mounting housing 111 to slide in the slot 104. The front annular disk 109*a* and the rear annular disk 109*b* can be construed as stabilizing members, since they confine positioning and movement of the drive roller 112.

In the embodiment of FIGS. 1-5B, as illustrated, the front annular disk 109*a* and the rear annular disk 109*b* have been shown to be of unequal thickness where the rear annular disk 109*b* is thicker than the front annular disk 109*a*. The thicker rear annular disk 109*b* can provide a sturdy base for receiving the mounting housing 111. Moreover, the thicker rear annular disk 109*b* can provide a sturdy structure for interaction with the controller 106.

In order to facilitate the vertical adjustment of the drive roller 112, the controller 106 includes a biasing mechanism such as a stud 110 having a compression spring 110*a* coaxially disposed around its shank. The stud 110 and the compression spring 110*a* are positioned below the rear annular disk 109*b* in order to vertically support the rear annular disk 109*b*. The stud 110 can extend into the rear annular disk 109*b* to an extent as can insure proper alignment of the drive roller 112 and additionally can prevent rotation of the mounting housing 111. An adjustment mechanism, such as a threaded bolt 108*a*, extends through the top of the frame 102, and a knob 108 is mounted on the free end of the threaded bolt 108*a*. The opposite end of the threaded bolt 108*a* bears against the rear annular disk 109*b*, pressing the rear annular disk 109*b* against the compression spring to 110*a* to fix the height of the drive roller 112. The height of the drive roller 112 can be adjusted by using the knob 108 to screw the threaded bolt 108*a* into and out of the frame 102, thereby clamping the drive roller 112 against one of the butt ends of the sheet 208. The threaded bolt 108*a* can also extend, at least partially, into the rear annular disk 109*b*. As shown in FIGS. 1-4, the knob 108 can be a four pronged handle or any other common attachment, such as a wheel or lever that can assist the user in manipulating the controller 106.

The frame 102 also includes a plurality of idler rollers 126 disposed below the drive roller 112 forming a gap 128 where a butt end of the sheet 208 can be inserted between the drive roller 112 and the idler rollers 126, such as where the butt end of the sheet 208 can be inserted between the drive roller 112 and the track 200 with the idler rollers 126 positioned to an underside 204 of the track 200, as best seen in FIGS. 1, 2, 4 and 5B. Each idler roller 126 is also desirably provided with an annular groove 124 proximate the base thereof. The annular grooves 124 on the idler rollers 126 function similarly to the annular groove 114 on the drive roller 112. In that regard, the annular grooves 124 are configured to engage the bottom portion of the lip 202 as best seen in FIG. 5B. The disposition of the drive roller 112 and the idler rollers 126 form a generally triangular configuration. In use, the plurality of idler rollers 126 can follow, for example, along the underside 204 of the track 200 as best shown in FIGS. 5A and 5B when the frame 102 is moved along the track 200 forming the tapered butt end on the sheet 208. Placement of the plurality of idler rollers 126 along the underside 204 of the track 200 allows for the drywall tapering device 100 to be further secured to the track 200, and the annular grooves 124 are vertically aligned with the annular groove 114 on the drive roller 112 so that a relatively secure, accurate and properly aligned engagement can be maintained throughout the operation of the drywall tapering device 100, such as can enhance the efficiency of the process of forming a tapered edge, as for example, on the sheet 208. Additionally, by placing the plurality of idler rollers 126 along the underside 204 of the track 200, when downward pressure is applied onto the drive roller 112 which would also be applied onto the sheet of material 208 and onto the track 200, the plurality of idler rollers 126 will be forced up and can come into further contact with the underside 204 of the track 200. This can allow the downward pressure applied to the drive roller 112 to be applied along the end of the sheet 208 to be tapered while the drywall tapering device 100 is traveling along the track 200 and across the sheet 208. This downward force applied by the drive roller 112 onto one of the ends of the sheet 208 allows for the formation of a tapered edge thereon.

Referring to FIG. 5A, the system for tapering drywall 500 includes a table 206 where both the track 200 and the table 206 are adapted to receive the sheet 208. The table 206 can be formed from any common components, including a plurality of horses and a plurality of pipes over welded struts connected together by a plurality of brackets, for example. The track 200 can be secured to the table 206 by any common securing mechanisms, including brackets or braces, among others. By using this type of configuration and components in the system for tapering drywall 500, the table 206 and track 200 can be assembled and disassembled relatively easy and quickly. This can allow for the system for tapering drywall 500 to be assembled and disassembled by the user at a job site.

In use, the user places the sheet 208 onto the table 206 and the track 200. In this instance, the sheet 208 is a drywall panel of a conventional thickness, e.g., ½ inch, ⅝ inch, etc. It is to be understood that the drywall tapering device 100 can also be used on compressible webs where a taper can be formed. The user aligns the butt end to be tapered by the drywall tapering device 100 onto the track 200 behind the lip 202, the lip 202 forming a fence for alignment of the butt end of the sheet 208. In the embodiment shown, the lip 202 is desirably an elongate, vertical bar extending above and below the horizontal portion of the track 200. This configuration permits the top part of the lip 202 to engage the annular groove 114 of the drive roller 112 while the bottom part of the lip 202 can engage the annular groove 124 on the idler rollers 126. The user then places the annular groove 114 of the drywall tapering device 100 in communication with the lip 202 of the track 200, which also facilitates mutual communication between the lip 202 and the annular grooves 124. The user connects the drive mechanism 124 to the drive attachment 122 of the drywall tapering device 100 to selectively move the drywall tapering device 100 across the butt end of the sheet 208 to be tapered. Movement of the drywall tapering device 100 across the butt end the sheet of material 208 compresses and forms the new tapered edge, such as tapered edge 606*b* shown in FIG. 6B. Depending on the user's needs, the user can adjust the vertical position of the drive roller 112 to accept different thicknesses of sheets 208 by manipulating the controller 106 of the drywall tapering device 100 which can selectively position the drive roller 112 along the slot 104 of the drywall tapering device 100.

Figure 6A:
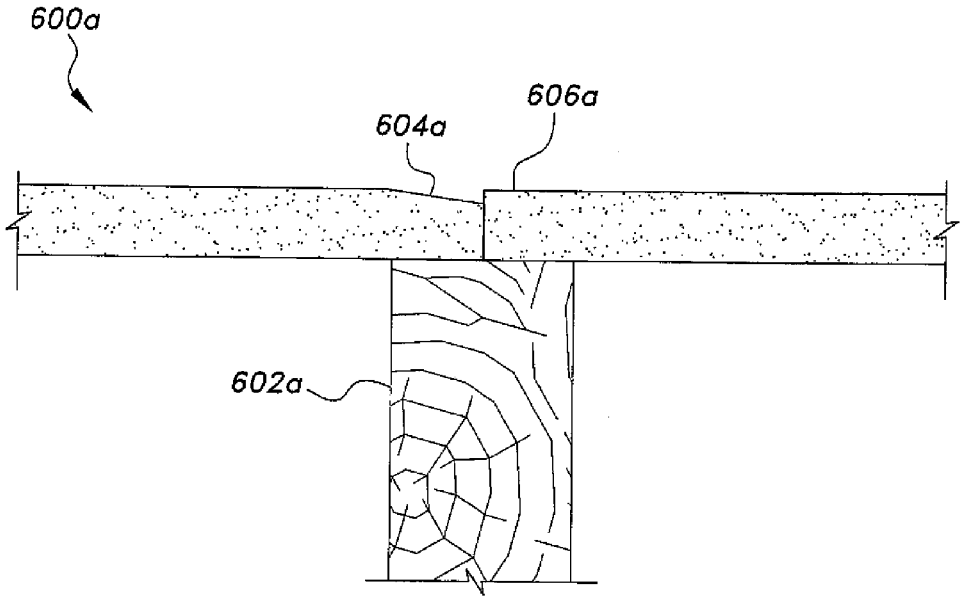
FIG. 6A is a top view of a butt joint.
Figure 6B:
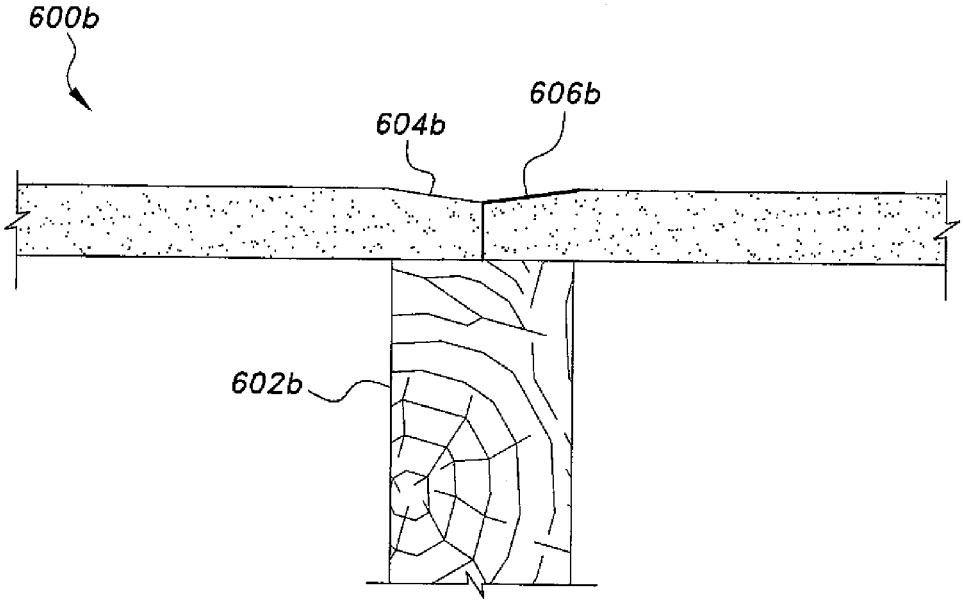
FIG. 6B is a top view of a seam joint formed by a factory tapered butt end and a tapered butt end created by a drywall tapering device and a system for tapering drywall according to the present invention.

Referring to FIGS. 6A and 6B, a butt joint 600*a* and a seam joint 600*b* are shown. The butt joint 600*a* is formed when a factory tapered edge 604*a* is placed adjacent to a non-factory tapered edge 606*a*. The butt joint 600*a* can form bulges or unevenness when tape and compound are placed within the butt joint 600*a* and therefore should be avoided as being typically undesirable. In comparison, as shown in FIG. 6B, a seam joint 600*b* is formed when a factory tapered edge 604*b* is placed adjacent to a tapered edge 606*b* that was reworked or formed by the drywall tapering device 100 and the system for tapering drywall 500. The seam joint 600*b* can allow for taping and compound to be filled into the seam joint 600*b* without typically leaving a bulge or unevenness in the wall, and thereby can allow for a smooth and even surface in the wall or ceiling, for example.

It is to be understood that the present invention encompasses a variety of alternatives. Though the specification describes forming one butt end on a sheet for tapering, the drywall tapering device 100 can be used to form tapered butt ends on any desired one or more sides of the sheet 208. Additionally, the drywall tapering device 100 can be constructed from any sturdy materials such as steel, plastic, composites, combinations thereof and the like. Furthermore, the drywall tapering device 100 can form tapers without the track 200 where the front face of the frame 102 forms a sufficient alignment surface for the sheet 208 to be tapered and the idler rollers 126 provide sufficient support for the drywall tapering device 100 to travel along the end of the sheet 208 to be tapered.

It is to be understood that the present invention is not limited to the embodiments described above, but encompasses any and all embodiments within the scope of the following claims.

We claim:

1. A drywall tapering device, comprising:

a frame, the frame having a slot, a front face, a rear face, and a top;

a drive roller extending from the front face of the frame, the drive roller slidably mounted within the slot of the frame for selectively positioning the drive roller along the slot, the drive roller having a base and a free end, the drive roller having an annular groove defined around the base and adapted for receiving a lip of a track to guide the frame, the drive roller having a shape that tapers in diameter from wide to narrow as the drive roller extends from its base to its free end, the drive roller having a mandrel to drive the frame along the track and move the drive roller;

a plurality of idler rollers, the plurality of idler rollers extending from the front face of the frame forming a generally triangular configuration with the drive roller, the plurality of idler rollers adapted for positioning along an underside of the track movable in conjunction with the drive roller; and a spring-biased adjustment screw assembly, the spring-biased adjustment screw assembly positioned in conjunction with the frame and in communication with the drive roller to clamp the drive roller against a butt end of a sheet of drywall with the lip of the track engaging the annular groove.

2. The drywall tapering device according to claim 1, wherein the plurality of idler rollers have a generally cylindrical shape, and the drive roller has a generally frustoconical shape.

3. The drywall tapering device according to claim 1, wherein the mandrel is adapted to selectively couple with a drive mechanism to drive the drive roller and move the frame along the track.

4. The drywall tapering device according to claim 3, wherein the drive mechanism comprises a power tool.

5. The drywall tapering device according to claim 1, further comprising:

stabilizing members to confine position and movement of the drive roller within the slot.

6. The drywall tapering device according to claim 5, wherein the stabilizing members comprise a mounting housing to rotatably support the drive roller, a front annular disk and a rear annular disk disposed on the mounting housing, the rear annular disk being spaced from the front annular disk, the front annular disk and the rear annular disk straddling the frame to substantially prevent undesirable movement of the drive roller within the slot.

7. The drywall tapering device according to claim 6, wherein the spring-biased adjustment screw assembly comprises:

a stud mounted to the frame and in communication with the rear annular disk, the stud having a shank;

a compression spring coaxially disposed around the shank of the stud, the stud and the compression spring vertically supporting the rear annular disk from beneath the rear annular disk;

a threaded bolt extending through the top of the frame, the threaded bolt having a free end and an opposite end in communication with the rear annular disk; and a knob mounted to the free end of the threaded bolt, wherein selective manipulation of the knob rotates the threaded bolt to thereby press against the rear annular disk and adjust a vertical position of the drive roller within the slot.

8. The drywall tapering device according to claim 1, wherein the drive roller and the plurality of idler rollers are positioned in spaced apart relation to form a gap adapted to receive a butt end of the sheet.

9. The drywall tapering device according to claim 8, wherein the drive roller is adapted to selectively contact and compress the butt end of the sheet to shape the butt end of the sheet.

10. The drywall tapering device according to claim 1, wherein the plurality of idler rollers each comprises an annular groove formed proximate a base thereof, the annular groove of a respective idler roller adapted for selective engagement with the lip of the track.

11. A system for tapering drywall, comprising:

a frame, the frame having a slot;

a track to engage the frame, the track positioned in conjunction with a table, the track having a lip;

a drive roller, the drive roller in communication with the slot of the frame for selectively positioning the drive roller along the slot, the drive roller having a groove adapted for receiving the lip of the track to guide the frame, the drive roller having a shape that tapers from the groove of the drive roller towards a front edge of the drive roller, the drive roller having a drive attachment positioned in conjunction with a rear of the drive roller to drive the frame along the track and move the drive roller;

a plurality of idler rollers, the plurality of idler rollers positioned in conjunction with the frame, the plurality of idler rollers adapted for positioning along an underside of the track movable in conjunction with the drive roller;

a controller, the controller positioned in conjunction with the frame and in communication with the drive roller to selectively control a position of the drive roller along the slot;

a biasing member positioned in communication with the controller to maintain an adjusted position of the drive roller; and a drive mechanism, the drive mechanism adapted to communicate with the drive attachment of the drive roller to drive the drive roller to move the frame along the track.

12. The system for tapering drywall according to claim 11, wherein the plurality of idler rollers have a generally cylindrical shape, and the drive roller has a generally tapered cylindrical shape.

13. The system for tapering drywall according to claim 11, wherein the drive mechanism is a power tool.

14. The system for tapering drywall according to claim 11, further comprising:

stabilizing members to confine position and movement of the drive roller within the slot.

15. The system for tapering drywall according to claim 14, wherein the stabilizing members comprise a mounting housing to rotatably support the drive roller, a front annular disk and a rear annular disk disposed on the mounting housing, the rear annular disk being spaced from the front annular disk, the front annular disk and the rear annular disk straddling the frame to substantially prevent undesirable movement of the drive roller within the slot.

16. The system for tapering drywall according to claim 15, wherein the controller comprises:

a threaded bolt extending through a top of the frame, the threaded bolt having a free end and an opposite end in communication with the rear annular disk; and a knob mounted to the free end of the threaded bolt, wherein selective manipulation of the knob rotates the threaded bolt to thereby press against the rear annular disk to adjust a vertical position of the drive roller within the slot.

17. The system for tapering drywall according to claim 11, wherein the lip comprises:

a fence, the fence adapted to receive an edge of a sheet and align the sheet for shaping a butt end of the sheet.

18. The system for tapering drywall according to claim 11, wherein the groove of the drive roller comprises an annular groove.

19. The system for tapering drywall according to claim 11, wherein the groove of the drive roller comprises an annular groove and the plurality of idler rollers each comprises an annular groove fanned proximate a base thereof, the annular groove of a respective idler roller adapted for selective engagement with the lip of the track.

20. The system for tapering drywall according to claim 11, wherein the plurality of idler rollers each comprises an annular groove formed proximate a base thereof, the annular groove of a respective idler roller adapted for selective engagement with the lip of the track.

* * * * *